US006530866B2

(12) United States Patent
Lo et al.

(10) Patent No.: US 6,530,866 B2
(45) Date of Patent: Mar. 11, 2003

(54) TREADING EXERCISER WITH HEART BEAT MONITORING CAPABILITY

(75) Inventors: Kun-Chuan Lo, No 3, Ching-Cheng 4th St., Taichung City (TW); Nathan Pyles, Lake Mills, WI (US)

(73) Assignee: Kun-Chuan Lo, Taichung (TW)

( * ) Notice: Subject to any disclaimer, the term of this patent is extended or adjusted under 35 U.S.C. 154(b) by 0 days.

(21) Appl. No.: 09/876,266

(22) Filed: Jun. 7, 2001

(65) Prior Publication Data

US 2002/0187878 A1 Dec. 12, 2002

(51) Int. Cl.[7] ..... A63B 22/02
(52) U.S. Cl. ..... 482/54; 482/1; 482/8
(58) Field of Search ..... 482/1–9

(56) References Cited

U.S. PATENT DOCUMENTS 6,033,344 A * 3/2000 Trulaske et al. ..... 482/7

* cited by examiner

*Primary Examiner*—Nicholas D. Lucchesi
*Assistant Examiner*—Tam Nguyen
(74) *Attorney, Agent, or Firm*—Trop, Pruner & Hu, P.C.

(57) ABSTRACT

A treading exerciser has a grip member which is retained removably by a grip retainer on an upper portion of an upright post that is connected to a front end of a treading base. The grip member is adapted to be gripped by one hand of the user of the treading exerciser, and has a sensor unit mounted thereon and adapted to detect the heart beat of the user and to generate an electrical signal corresponding to the heart beat. An electrical cable unit connects the sensor unit to a control panel on the upright post, thereby enabling the control panel to monitor the heart beat of the user.

4 Claims, 6 Drawing Sheets

TREADING EXERCISER WITH HEART BEAT MONITORING CAPABILITY

BACKGROUND OF THE INVENTION

1. Field of the Invention

The invention relates to a treading exerciser with a heart beat monitoring capability, more particularly to a treading exerciser with a removable grip member which has a sensor unit for detecting the heart beat of the user.

2. Description of the Related Art

Referring to FIGS. 1 and 2, a conventional treading exerciser is shown to comprise a treading base 1, an upright post 2, and a control panel 3.

The treading base 1 has a top side 101, a bottom side 103 opposite to the top side 101 and adapted to be disposed on a ground surface, a front end, and a rear end opposite to the front end. The treading base 1 is provided with a tread belt device 102 that extends between the front and rear ends and that is exposed from the treading base 1 at the top side 101 so as to be adapted to be treaded by the user. The bottom side 103 is provided with a plurality of leg members 104 having casters 105 mounted thereon.

The upright post 2 has a lower portion connected to the front end of the treading base 1, and an upper portion opposite to the lower portion. The upper portion of the upright post 2 has a handle unit that includes a pair of handle members 202 extending therefrom.

The control panel 3 has a top face 301, which is provided with a plurality of control keys 302 and a display unit 303. The lower part of the control panel 3 is formed with a pair of recesses 304. Each of the recesses 304 has a grip bar 305 provided therein. One of the grip bars 305 is provided with a grip member 306, which has a sensor unit 307 mounted thereon for detecting the heart beat of the user.

In use, the feet of the user tread on the tread belt device 102, whereas the hands of the user are normally placed on the handle members 202. With further reference to FIG. 3, when the user wishes to monitor his/her heart beat, the user moves his/her hands from the handle members 202 to the grip bars 305. The sensor unit 307 on the grip member 306 then detects the heart beat of the user, and generates a corresponding electrical signal that is provided to the control panel 3. The control panel 3 provides the heart beat information on the display unit 303 thereof.

Although the conventional treading exerciser has the function of detecting the heart beat of the user, the grip member 306 with the sensor unit 307 for detecting the heart beat is mounted fixedly on the grip bar 305. As such, when the user wishes to monitor his/her heart beat during the course of treading exercise, the running posture of the user will be adversely restricted due to the need to grip the grip bars 305, thereby resulting in user discomfort. Moreover, inaccurate monitoring of the heart beat of the user easily occurs because movement of the hands of the user relative to the grip bars 305 normally happens during the course of treading exercise.

SUMMARY OF THE INVENTION

Therefore, the object of the present invention is to provide a treading exerciser with a removable grip member which has a sensor unit for detecting the heart beat of the user, thereby overcoming the aforesaid drawbacks of the prior art.

Accordingly, the treading exerciser of the present invention comprises:

a treading base having a top side, a bottom side opposite to the top side and adapted to be disposed on a ground surface, a front end, and a rear end opposite to the front end, the treading base being provided with a tread belt device that extends between the front and rear ends and that is exposed from the treading base at the top side so as to be adapted to be treaded by the user;

an upright post having a lower portion connected to the front end of the treading base, and an upper portion opposite to the lower portion;

a control panel mounted on the upper portion of the upright post;

a grip retainer mounted on the upper portion of the upright post;

a grip member retained removably on the grip retainer and adapted to be gripped by one hand of the user treading on the tread belt device, the grip member having a sensor unit mounted thereon and adapted to detect heart beat of the user and to generate an electrical signal corresponding to the heart beat; and an electrical cable unit having one end connected to the sensor unit and an opposite end connected to the control panel, thereby enabling the control panel to receive the electrical signal from the sensor unit and to monitor the heart beat of the user.

Because the grip member is retained removably on the upright post via the grip retainer, the user of the treading exerciser can readily and comfortably monitor his/her heart beat by gripping the grip member during the course of treading exercise.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
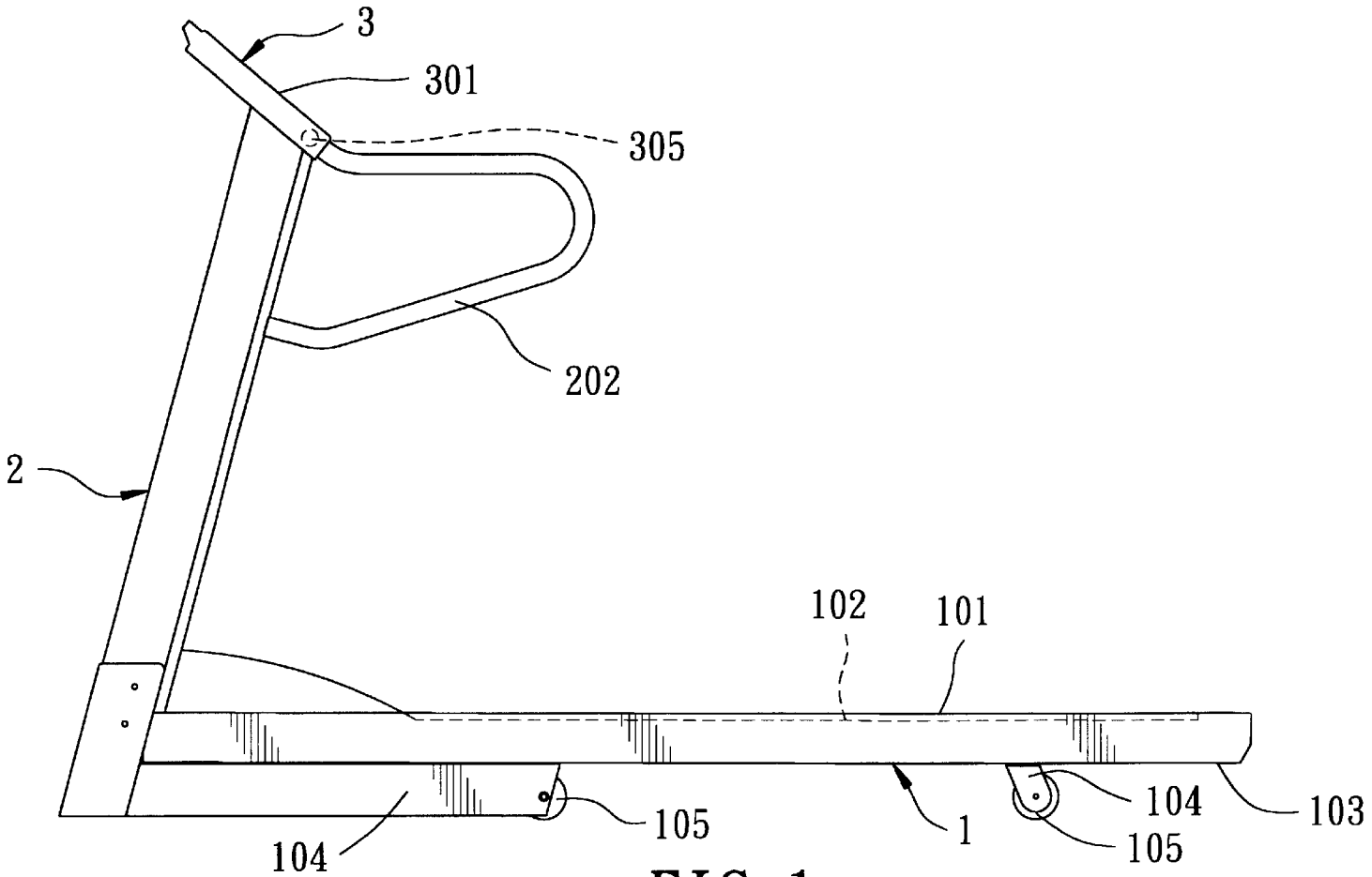
FIG. 1 PRIOR ART
FIG. 1 is a schematic side view of the conventional treading exerciser.
Figure 2:
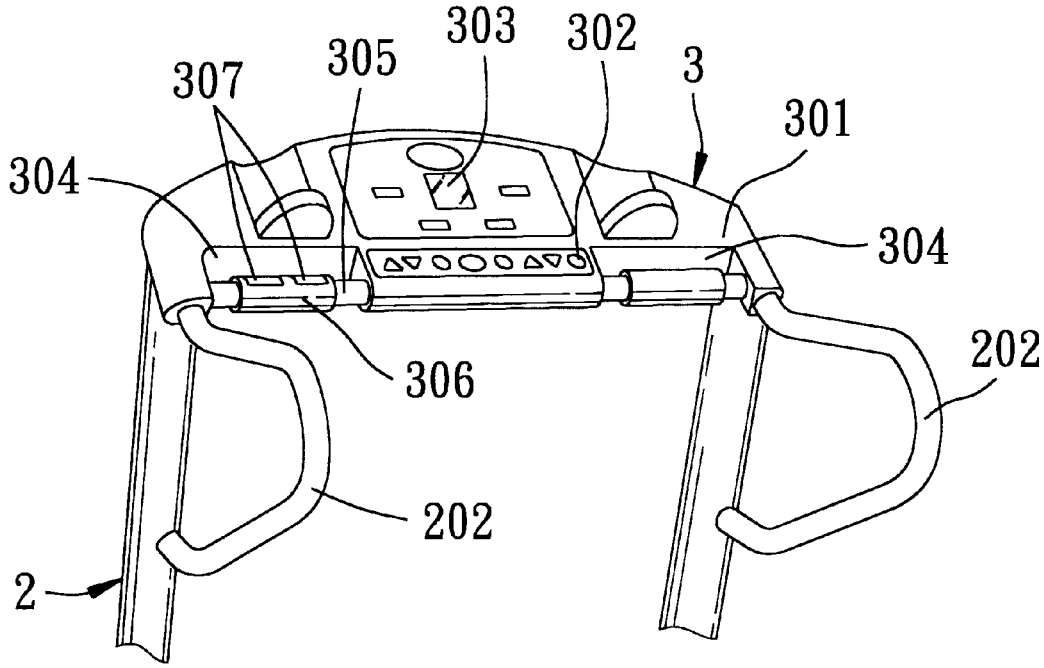
FIG. 2 PRIOR ART
FIG. 2 is a fragmentary perspective view of the conventional treading exerciser.
Figure 3:
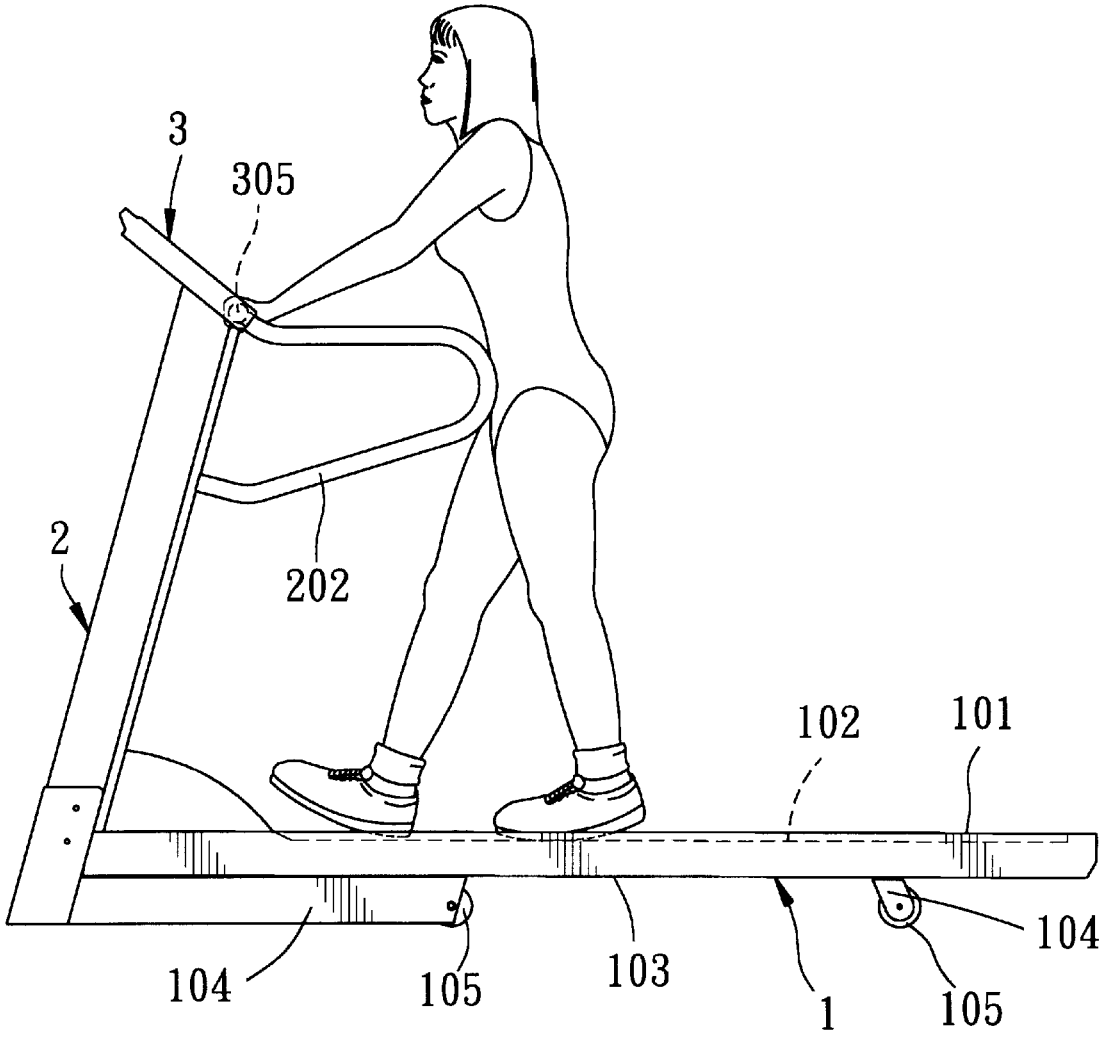
FIG. 3 PRIOR ART
FIG. 3 is a schematic side view showing the conventional treading exerciser in a state of use.
Figure 4:
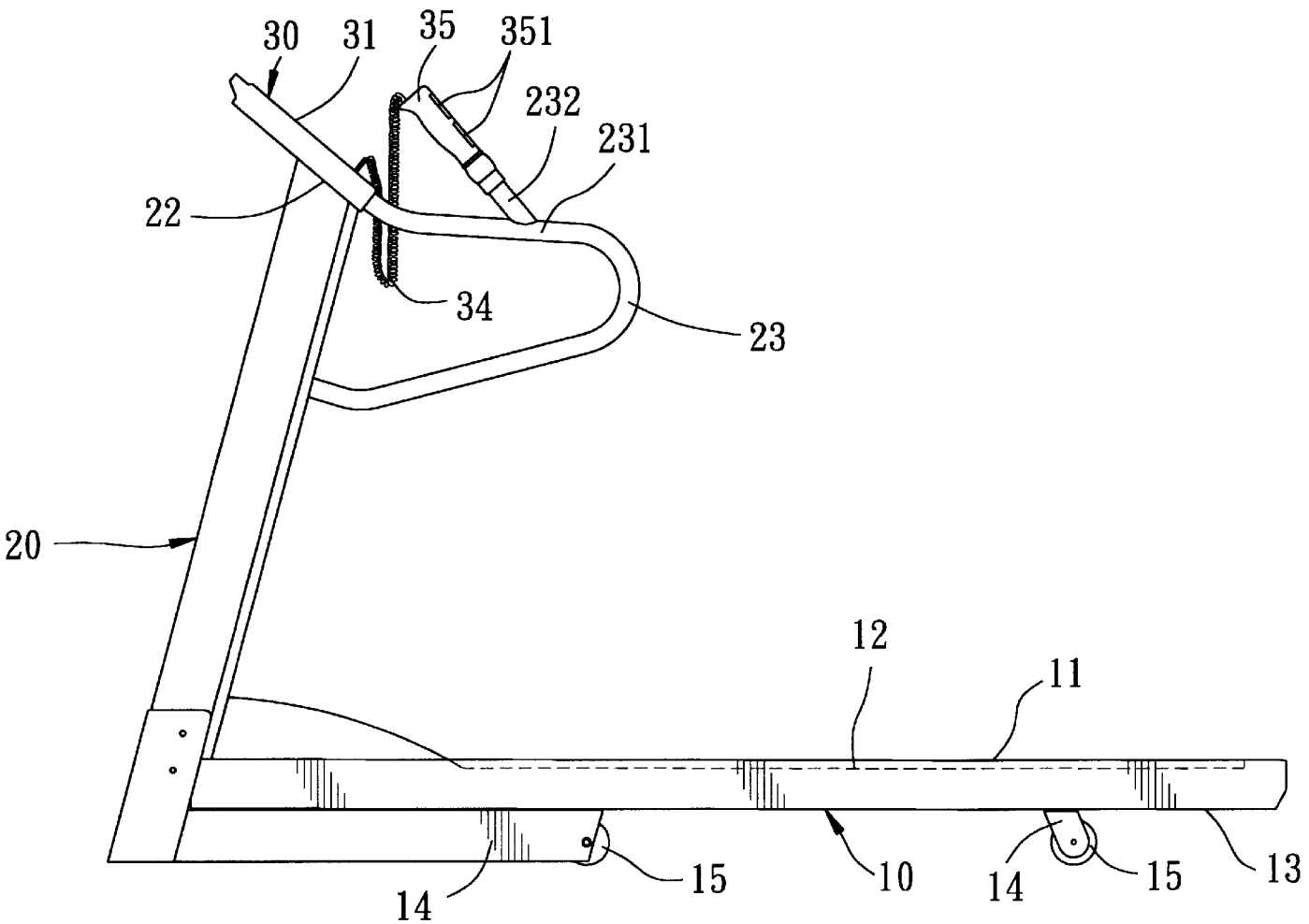
FIG. 4 is a schematic side view of the preferred embodiment of a treading exerciser according to this invention.
Figure 5:
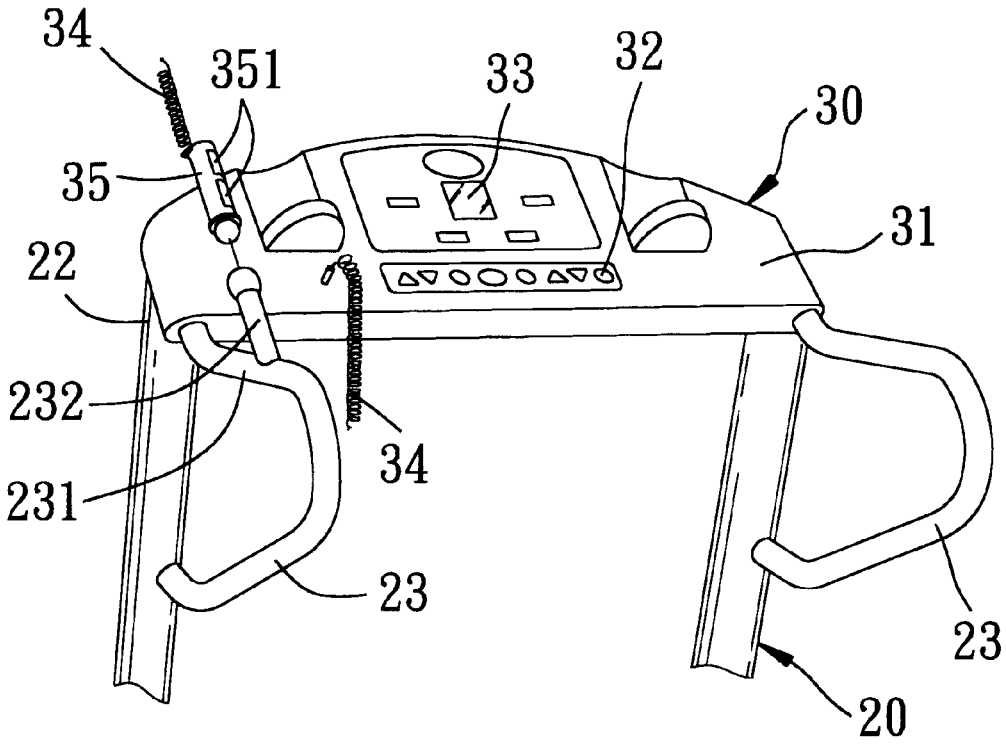
FIG. 5 is a fragmentary perspective view of the preferred embodiment.

Referring to FIGS. 4 and 5, the preferred embodiment of a treading exerciser according to the present invention is shown to comprise a treading base 10, a upright post 20 having a lower portion connected to a front end of the treading base 10, and a control panel 30 mounted on an upper portion 22 of the upright post 30.

The treading base 10 has a top side 11, a bottom side 13 opposite to the top side 11 and adapted to be disposed on a ground surface, and a rear end opposite to the front end. The treading base 10 is provided with a conventional tread belt device 12 that extends between the front and rear ends and that is exposed from the treading base 10 at the top side so as to be adapted to be treaded by the user in a known manner.

Additionally, the bottom side 13 of the treading base 10 is provided with a plurality of leg members 14 having casters 15 mounted thereon.

The control panel 3, which is conventional in construction, has a top face 31 provided with a plurality of control keys 32 and a display unit 33.

The upper portion 22 of the upright post 20 has a handle unit that includes a pair of handle members 23 extending therefrom. A grip retainer 232 is mounted on an upper part 231 of one of the handle members 23. Particularly, the grip retainer 232 has a lower securing portion secured to the upper part 231 of the handle member 23, and an upper tubular receiving portion that extends upwardly from the lower securing portion and that receives removably a grip member 35 therein.

The grip member 35 is retained removably on the upright post 20 via the grip retainer 232, and is adapted to be gripped by one hand of the user treading on the tread belt device 12. The grip member 35 has a conventional sensor unit 351 mounted thereon. The sensor unit 351 is adapted to detect the heart beat of the user and to generate an electrical signal corresponding to the heart beat in a known manner.

An electrical cable unit 34 has one end connected to the sensor unit 351 and an opposite end connected to the control panel 30, thereby enabling the control panel 30 to receive the electrical signal from the sensor unit 351 and to monitor the heart beat of the user.

Figure 6:
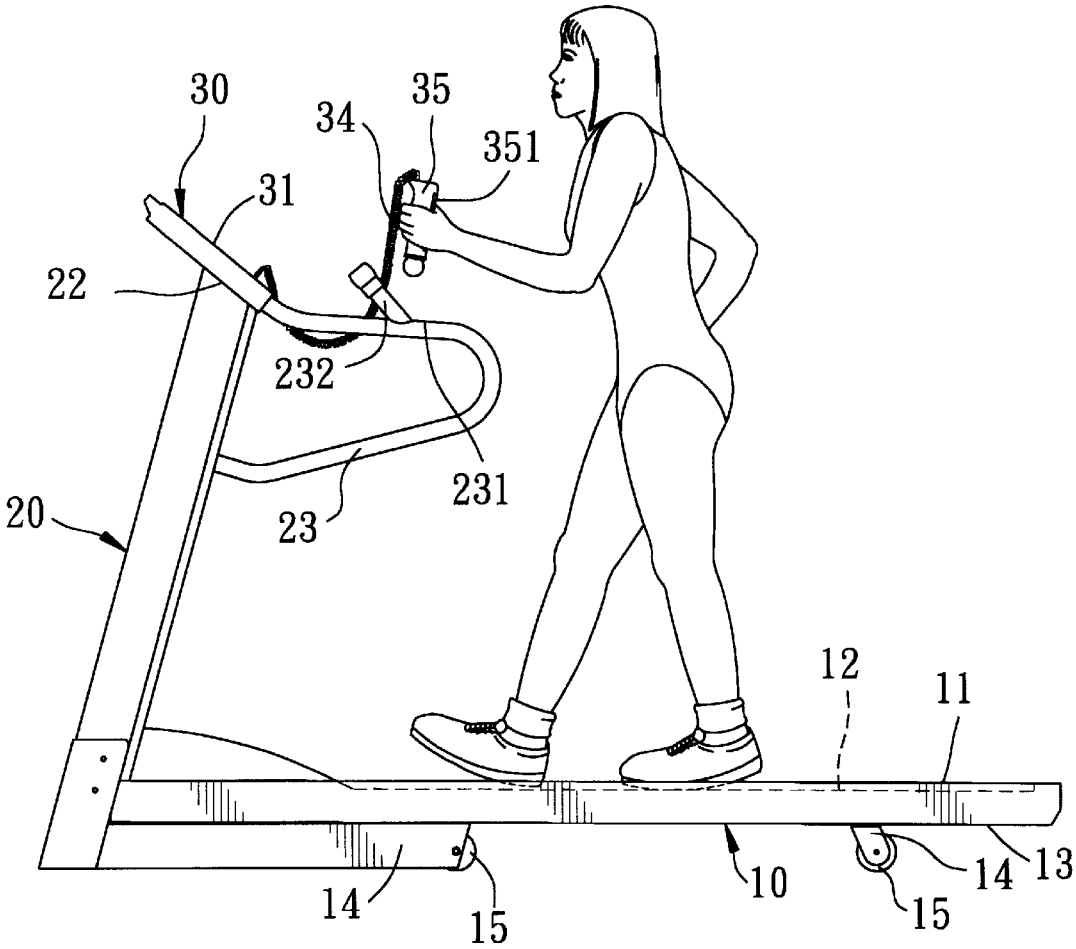
FIG. 6 is a schematic side view showing the preferred embodiment in a state of use.

In use, when the user is running on the treading exerciser of this invention, the feet of the user tread on the tread belt device 12, whereas the hands of the user are normally placed on the handle members 23. With further reference to FIG. 6, when the user wishes to monitor his/her heart beat during the course of treading exercise, the user can remove the grip member 35 from the grip retainer 232. In view of the contact between the hand of the user and the sensor unit 351 on the grip member 35, the sensor unit 351 can detect the heart beat of the user and generate an electrical signal corresponding to the heart beat. The control panel 30 subsequently receives the electrical signal from the sensor unit 351 via the electrical cable unit 34. As a result, the control panel 30 can operate to provide heart beat information in a manner similar to the prior art.

In view of the aforesaid, because the grip member 35 is retained removably on the upright post 20 via the grip retainer 232, the user of the treading exerciser of this invention can readily and comfortably monitor his/her heart beat by gripping the grip member 35 during the course of treading exercise without encountering any undue restriction in his/her running posture. Moreover, as compared to the conventional treading exerciser described beforehand, accurate monitoring of the heart beat of the user can be achieved because the hand of the user does not move relative to the grip member 35 in the treading exerciser of this invention during the course of treading exercise. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A treading exerciser comprising:

a treading base having a top side, a bottom side opposite to said top side and adapted to be disposed on a ground surface, a front end, and a rear end opposite to said front end, said treading base being provided with a tread belt device that extends between said front and rear ends and that is exposed from said treading base at said top side so as to be adapted to be treaded by the user;

an upright post having a lower portion connected to said front end of said treading base, and an upper portion opposite to said lower portion;

a control panel mounted on said upper portion of said upright post;

a grip retainer mounted on said upper portion of said upright post;

a grip member retained removably on said grip retainer and adapted to be gripped by one hand of the user treading on said tread belt device, said grip member having a sensor unit mounted thereon and adapted to detect heart beat of the user and to generate an electrical signal corresponding to the heart beat; and an electrical cable unit having one end connected to said sensor unit and an opposite end connected to said control panel, thereby enabling said control panel to receive the electrical signal from said sensor unit and to monitor the heart beat of the user.

2. The treading exerciser of claim 1, wherein said treading base is further provided with a plurality of casters at said bottom side.

3. The treading exerciser of claim 1, wherein said upper portion of said upright post has a handle unit extending therefrom, said grip retainer being mounted on said handle unit.

4. The treading exerciser of claim 3, wherein said grip retainer has a securing portion secured to said handle unit, and a tubular receiving portion that extends upwardly from said securing portion and that receives removably said grip member therein.

* * * * *